US006899238B2

(12) United States Patent
Austin et al.

(10) Patent No.: US 6,899,238 B2
(45) Date of Patent: May 31, 2005

(54) METHODS AND APPARATUS FOR SUPPORTING A DAVIT ARM

(75) Inventors: Barry J. Austin, Houston, TX (US); Travis P. Betcher, Goodhue, MN (US); Weston L. Cutter, Mendota Heights, MN (US); Patrick J. Novak, North Liberty, IA (US)

(73) Assignee: D B Industries, Inc., Red Wing, MN (US)

( * ) Notice: Subject to any disclaimer, the term of this patent is extended or adjusted under 35 U.S.C. 154(b) by 75 days.

(21) Appl. No.: 10/266,099

(22) Filed: Oct. 4, 2002

(65) Prior Publication Data

US 2003/0116518 A1 Jun. 26, 2003

Related U.S. Application Data

(60) Provisional application No. 60/327,546, filed on Oct. 5, 2001.

(51) Int. Cl.[7] ..... B66C 23/26

(52) U.S. Cl. ..... 212/270; 212/175; 212/901

(58) Field of Search ..... 212/901, 180, 212/270, 175, 179

(56) References Cited

U.S. PATENT DOCUMENTS

| | | | | | |
|---|---|---|---|---|---|
| 2,804,979 | A | * | 9/1957 | Lassiter | 212/301 |
| 3,980,276 | A | * | 9/1976 | Burkland | 254/415 |
| 4,511,123 | A | * | 4/1985 | Ostrobrod | 254/364 |
| 4,589,523 | A | * | 5/1986 | Olson et al. | 182/234 |
| 4,660,679 | A | * | 4/1987 | Ostrobrod | 182/18 |
| 4,671,478 | A | * | 6/1987 | Schoenig et al. | 248/124.1 |
| 4,838,439 | A | | 6/1989 | Baziuk | 212/254 |
| 4,881,864 | A | * | 11/1989 | Amato | 414/543 |
| 5,064,079 | A | * | 11/1991 | Bowerman | 212/345 |
| 5,211,526 | A | * | 5/1993 | Robinette | 414/550 |
| 5,341,898 | A | | 8/1994 | Baziuk | 182/142 |
| 5,617,963 | A | | 4/1997 | Baziuk et al. | 212/179 |
| 5,690,240 | A | * | 11/1997 | Thiermann, Sr. | 212/180 |
| 5,725,070 | A | * | 3/1998 | Eldred | 182/63.1 |
| 5,758,785 | A | * | 6/1998 | Spinosa et al. | 212/300 |
| 5,934,490 | A | * | 8/1999 | Mora | 212/176 |
| 5,975,499 | A | * | 11/1999 | Ostrobrod | 254/332 |
| 6,065,621 | A | * | 5/2000 | Fatemi et al. | 212/301 |
| 6,616,397 | B1 | * | 9/2003 | Lester | 414/540 |

OTHER PUBLICATIONS

Unique Concepts Ltd., UCL Safety Systems Specializing in Confined Space and Fall–arrest Safety Equipment, pp. 5–7 and 12–13, 1999, Canada.

* cited by examiner

*Primary Examiner*—Thomas J. Brahan
(74) *Attorney, Agent, or Firm*—IPLM Group, P.A.

(57) ABSTRACT

A davit arm system includes a base that supports a davit arm and engages an underlying ground surface. The system components are preferably designed for arrangement in alternative ways to accommodate different installation environments, and/or for packaging in a bag that may be carried by a single person. The relative positions of the components are preferably adjustable relative to the base to further accommodate different applications. Yet another desirable option is to mount the davit arm on the support base in a manner that allows rotation about both a vertical axis and a horizontal axis. A winch is preferably mounted on the davit arm in a manner that counterbalances the davit arm relative to its vertical axis of rotation.

4 Claims, 7 Drawing Sheets

METHODS AND APPARATUS FOR SUPPORTING A DAVIT ARM

This application claims the benefit of U.S. Provisional Patent Application No. 60/327,546, filed Oct. 5, 2001.

FIELD OF THE INVENTION

The present invention relates to methods and apparatus for supporting a davit arm, especially in proximity to a cliff or an opening into a confined space.

BACKGROUND OF THE INVENTION

Various occupations place people in dangerous environments, thereby creating a need for both safety equipment and rescue equipment. For example, a person may fall down a manhole or become injured while working in a space that is accessible via a manhole. In another scenario, a person may fall down off the edge of a cliff of become injured while working on the face of a cliff. As a result, it is often desirable to provide a ground engaging structure for supporting a cable that extends downward into the manhole (or down the face of a cliff) and is capable of withstanding forces associated with arresting a person's fall and/or raising an injured person. One such arrangement is known as a davit arm, and an example of a conventional davit arm arrangement is disclosed in U.S. Pat. No. 4,838,439 to Baziuk. An object of the present invention is to provide an improved davit arm system.

SUMMARY OF THE INVENTION

One aspect of the present invention is to provide a davit arm system with a support base that may be configured and arranged in alternative ways to accommodate different installation environments. For example, in a first configuration, the support base generally defines an H-shape or U-shape that occupies a horizontal plane and engages the ground near each end or corner of the base. The davit arm may be arranged to carry a load in alignment with the geometric center of the base, and/or the base may be weighted down to counterbalance an eccentric load relative to the geometric center of the base. In a second configuration, the support base generally defines an H-shape or inverted U-shape that occupies a vertical plane and engages the ground at first and second lower distal ends. In the second configuration, an additional member extends perpendicular to the H-shape or inverted U-shape and is configured to fit into a trailer hitch socket and/or various other types of suitable receptacles. Yet another configuration may be provided by rotating one of the side members of the base ninety degrees out of the plane occupied by the other base members. Additionally, the relative position of each side member is preferably adjustable relative to the center member of the support base.

Another aspect of the present invention is to provide a davit arm system with a davit arm that is rotatably mounted on the upper end of a support post, and a winch that is configured and arranged to counterbalance the davit arm relative to the davit arm's vertical axis of rotation. Also, the davit arm is preferably adjustable relative to the post along the axis of rotation and/or about a pivot axis that extends perpendicular to the axis of rotation. Any of the foregoing systems may also provided in a manner that facilitates packaging of the system components in discrete compartments of a bag for convenient hauling by a single person. Additional features and/or advantages of the present invention will become apparent from the more detailed description that follows.

BRIEF DESCRIPTION OF THE DRAWINGS

With reference to the figures of the drawings, wherein like numerals reference like parts and assemblies throughout the several views.

DETAILED DESCRIPTION OF THE PREFERRED EMBODIMENT

Figure 7A:
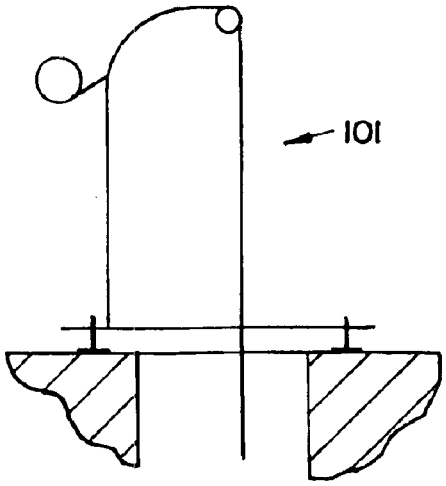
FIG. 7*a* is a diagrammatic view of the assembly 101 in an operative position relative to a manhole.
Figure 7B:
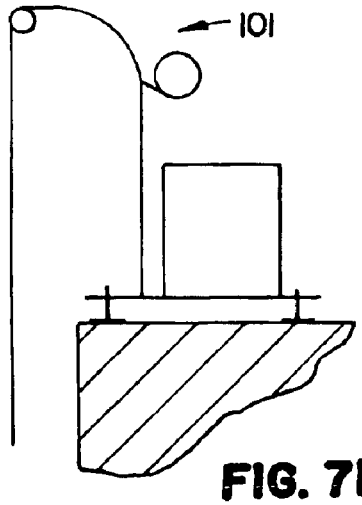
FIG. 7*b* is a diagrammatic view of the assembly 101 in an operative position relative to a cliff.

The present invention provides various davit arm support arrangements and assemblies, as well as a portable packaging arrangement and/or a kit having components suitable for constructing a variety of davit arm embodiments in response to various circumstances. A first davit arm assembly constructed according to the principles of the present invention is designated as 101 in FIG. 1. As suggested by FIG. 7*a*, the assembly 101 is designed to remain free standing on a ground surface disposed about an opening, such as pavement disposed about a manhole (for example, see U.S. Pat. No. 4,838,439 to Baziuk, which is incorporated herein by reference). As suggested by FIG. 7*b*, the assembly 101 may also be weighted down for use on a roof or in proximity to a cliff.

The free standing assembly 101 generally includes a central base member 110, first and second T-shaped supports 121 and 122, first and second legs 131 and 132, a central post 140, a central rod 150, and a davit arm 160. The base member 110 includes an elongate tube 111 having aligned first slits 112 and aligned second slits (not shown) at each end. As suggested by FIG. 3, the first slits 112 are circumferentially spaced ninety degrees relative to the second slits. First and second sockets or support tubes 114 and 118 are rigidly mounted to an intermediate portion of the elongate tube 111 and define an angle of ninety degrees therebetween. The socket 114 and the second slits are disposed on diametrically opposite sides of the elongate tube 111, and the socket 118 and the first slits 112 are disposed on diametrically opposite sides of the elongate tube 111. A reinforcing bracket 116 is rigidly secured between the socket 114 and the tube 111 (by welding, for example). Also, a reinforcing flange 117 is rigidly secured between the sockets 114 and 118 (by welding, for example).

Each T-shaped support 121 and 122 includes a sleeve 123 that is sized and configured to receive a respective leg 131 or 132. Each T-shaped support 121 and 122 also includes a transverse member 125 that is rigidly secured to an intermediate portion of the sleeve 123 and extends perpendicular thereto, thereby defining a T-shape. The transverse member 125 is sized and configured to fit within a respective end of the elongate tube 111. A flange 127 is rigidly secured between the transverse member 125 and the sleeve 123, and fits within any one first slit 112 or second slit.

Figure 1:
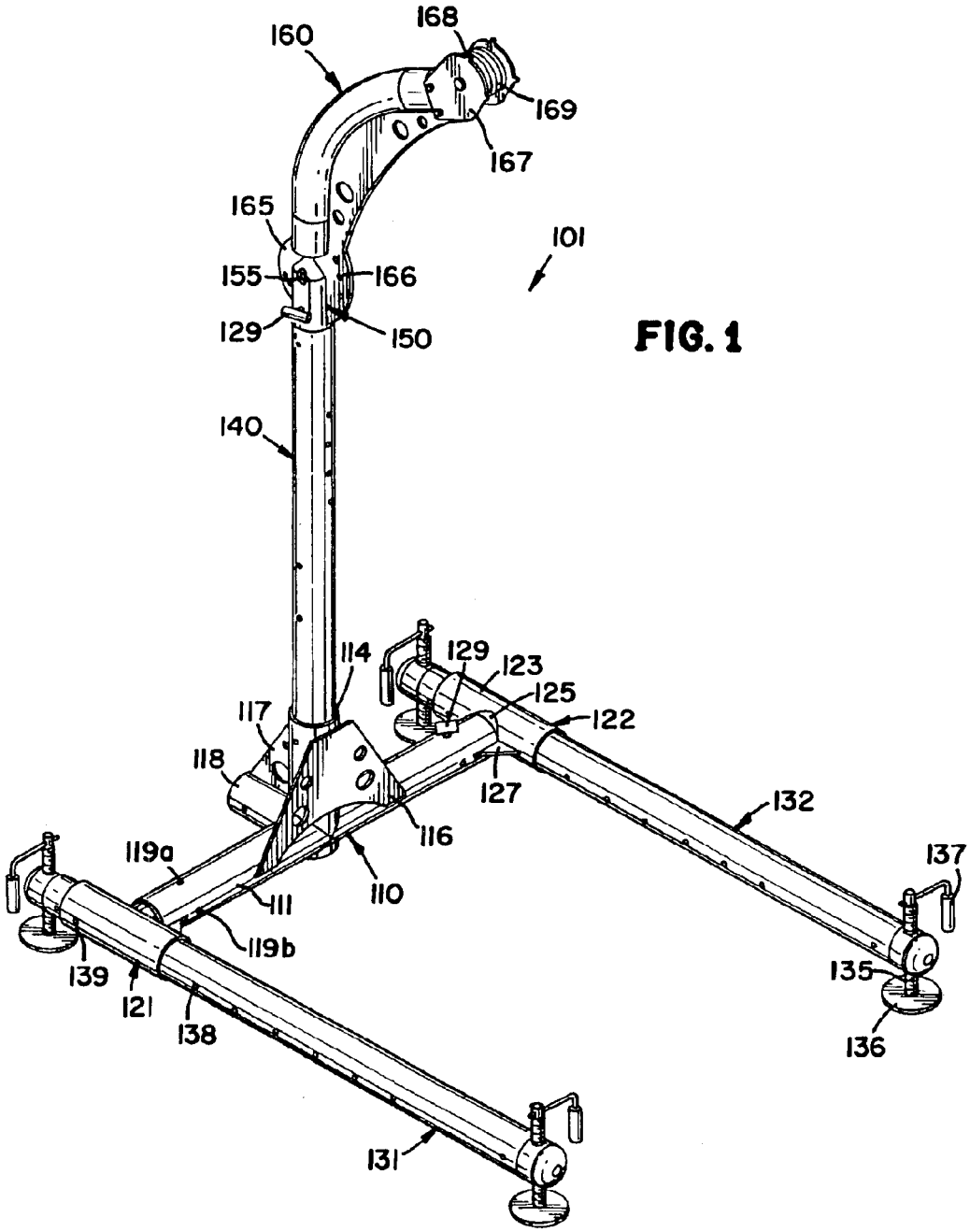
FIG. 1 is a perspective view of a davit arm and a support frame constructed according to the principles of the present invention and arranged in a first configuration.
Figure 3:
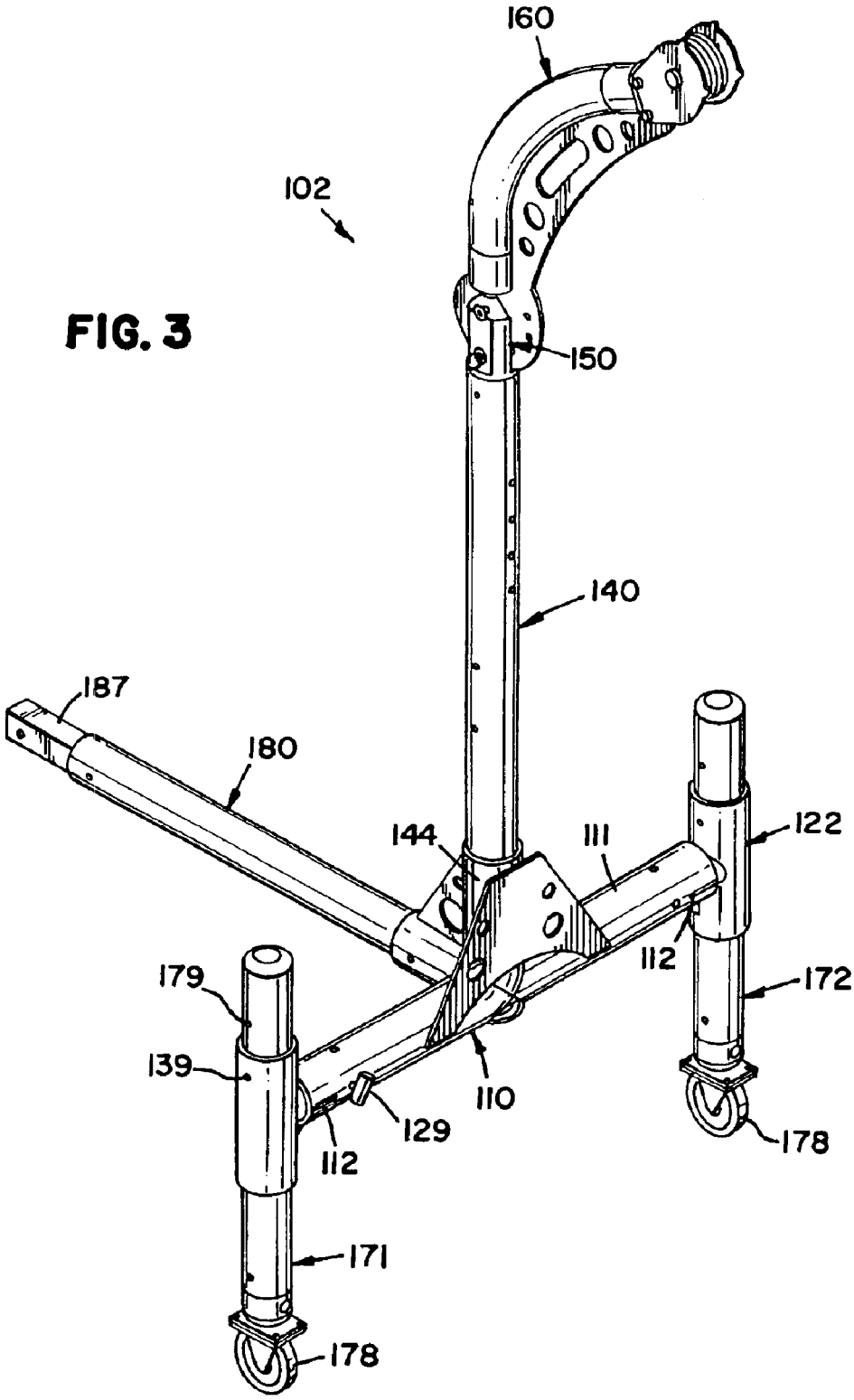
FIG. 3 is a perspective view of the davit arm of FIG. 1 and an alternative support frame constructed according to the principles of the present invention and arranged in a second configuration.

The slits in the elongate tube 111 cooperate with the flanges 127 to support the respective T-shaped supports 121 and 122 in either of two orientations relative to the base 110. FIG. 1 shows the T-shaped supports 121 and 122 (and the flanges 127) in a first, horizontal orientation relative to an underlying ground surface. Pop pins 129 (one of which is shown in FIG. 1) or other suitable fasteners may be inserted through upwardly facing holes 119*a* (one of which is shown in FIG. 1) in the elongate tube 111 and aligned holes in respective transverse members 125 to releasably fasten the T-shaped supports 121 and 122 to the base 111 in the manner shown in FIG. 1. FIG. 3 shows the T-shaped supports 121 and 122 (and the flanges 127) in a second, vertical orientation relative to an underlying ground surface. In this alternative arrangement, the same fasteners 129 may be inserted through laterally facing holes 119*b* in the elongate tube 111 and the same holes in respective transverse members 125 to releasably fasten the T-shaped supports 121 and 122 to the base 110 (as shown in FIG. 3). Due to the independent mounting of each T-shaped support 121 and 122, it is also possible (and may be desirable under certain circumstances) to arrange the individual T-shaped supports 121 and 122 in different orientations relative to one another.

Each of the legs 131 and 132 is an elongate member that extends through a respective sleeve 123. For each leg 131 and 132, a similar pop pin 129 or other suitable fastener is inserted through a hole 139 in the associated sleeve 123 and through any of several alignable holes 138 in a respective leg 131 or 132 to secure the leg 131 or 132 in any of several positions relative to the sleeve 123. Each leg 131 and 132 has opposite ends that are provided with threaded bores which extend perpendicular to the longitudinal axis of the leg 131 or 132. A separate bolt 135 is threaded into each bore and has a distal end that is secured to a disc-shaped plate 136. The bolts 135 may be rotated relative to respective legs 131 and 132 to adjust the overall orientation of the assembly 101. A separate crank handle 137 may be inserted through an opposite end of each bolt 135 to facilitate such rotation.

The central post 140 is an elongate tubular member having a lower end sized and configured to fit inside the socket 114 on the base 110, and an upper end that supports a thrust bearing and is sized and configured to receive the central rod 150. The post 140 is adjustable vertically (to a limited extent) relative to the socket 114. More specifically, a similar pop pin 129 or other suitable fastener is inserted through a hole 144 (shown in FIG. 3) in the socket 114 and one of several alignable holes in the post 140. The extent of the available adjustment is limited primarily by the length of the socket 114 and the clearance beneath the socket 114.

The central rod 150 has a lower end that is supported by the thrust bearing and extends into the post 140. As a result, the rod 150 is readily rotatable about a longitudinal axis defined by the post 140. An opposite, upper end of the rod 150 is split or forked, and is provided with two laterally extending holes for reasons explained below.

The davit arm 160 has a lower end 165 that is disc-shaped and fits inside the split upper end of the rod 150. A bolt 155 is inserted through the upper hole in the rod 150 and through an aligned, centrally located hole in the lower end 165 of the davit arm 160. A mating nut is threaded onto the bolt 155 to mount the davit arm 160 on the rod 150 for rotation about a horizontal axis (the longitudinal axis of the bolt 155) relative to the rod 150, and for rotation about a vertical axis (the longitudinal axis of the rod 150) together with the rod 150. A similar pop pin 129 or other suitable fastener is inserted through the lower hole in the rod and through one of several circumferentially spaced holes 166 in the lower end 165 of the davit arm 160 to selectively secure the davit arm 160 in one of several orientations relative to the rod 150. The maneuverability of the davit arm 160, as well as the adjustability of various components of the assembly 101, facilitate rescue operations in a variety of circumstances, including lifting an injured person from a manhole and onto a stretcher.

An opposite, upper end of the davit arm 160 is provided with a trunnion 167 and first and second pulleys 168 and 169 rotatably mounted adjacent one another on the trunnion 167. One of the pulleys 168 is preferably used to support and guide a cable associated with a conventional winch, and the other pulley 169 is preferably used to support and guide a cable associated with a conventional self-retracting lifeline (SRL) unit. The davit arm 160 may be described as generally L-shaped and/or banana-shaped, and is preferably provided with reinforcing brackets and/or flanges to ensure structural integrity. In any event, the upper distal end of the davit arm 160 is radially displaced from the longitudinal axis of the post 140.

FIG. 3 shows a second davit arm assembly 102 constructed according to the principles of the present invention. As suggested by the common reference numerals, the assembly 102 includes many of the same components as the assembly 101. Indeed, one of the many advantages of the present invention is that a group of parts may be used in various ways to provide various davit arm arrangements. As suggested by FIGS. 7*c*–7*d*, the assembly 102 is designed to mate with a trailer 78 hitch on a vehicle 70 and is suitable for use relative to both a manhole opening and a cliff.

As compared to the assembly 101, the T-shaped supports 121 and 122 on the assembly 102 have been rotated ninety degrees relative to the base member 110, and the legs 131 and 132 have been replaced by relative shorter legs 171 and 172. Each leg 171 and 172 slides inside a respective sleeve 123 and is releasably locked in place by a respective pop pin 129 or other suitable fastener inserted through a respective hole 139 and one of several alignable holes 179 in a respective leg 171 or 172. A caster or wheel 178 is mounted on the lower distal end of each leg 171 and 172.

Figure 7C:
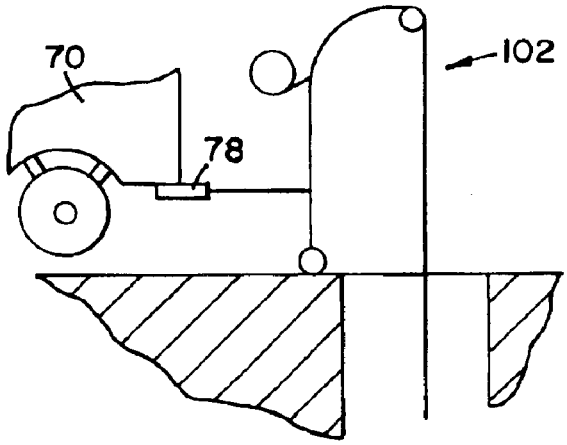
FIG. 7*c* is a diagrammatic view of the assembly 102 in an operative position relative to a manhole.
Figure 7D:
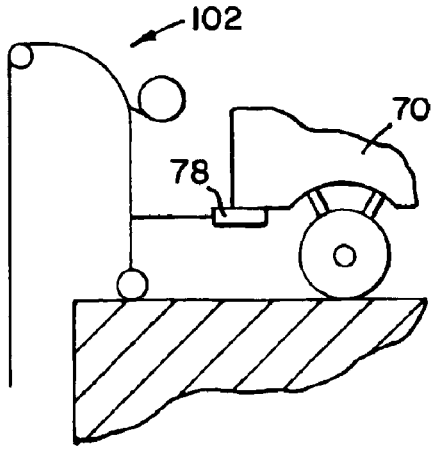
FIG. 7*d* is a diagrammatic view of the assembly 102 in an operative position relative to a cliff.

An elongate connector 180 has a first end that is inserted into the socket 118 on the base member 110 and secured in place by a pop pin 129 or other suitable fastener inserted through aligned holes in the connector 180 and the walls of the socket 118. An opposite end 187 of the connector 180 is sized and configured to mate with a receptacle on a vehicle. For example, the end 187 of the connector 180 has a square cross-section that fits into a trailer hitch receptacle 78 on a truck 70 (as shown in FIGS. 7*c*–7*d*). In other words, the connector 180 connects to the receptacle 78 in the same manner as a conventional trailer hitch. Those skilled in the art will recognize that other arrangements may be made for other sorts of vehicle connection points.

Figure 4:
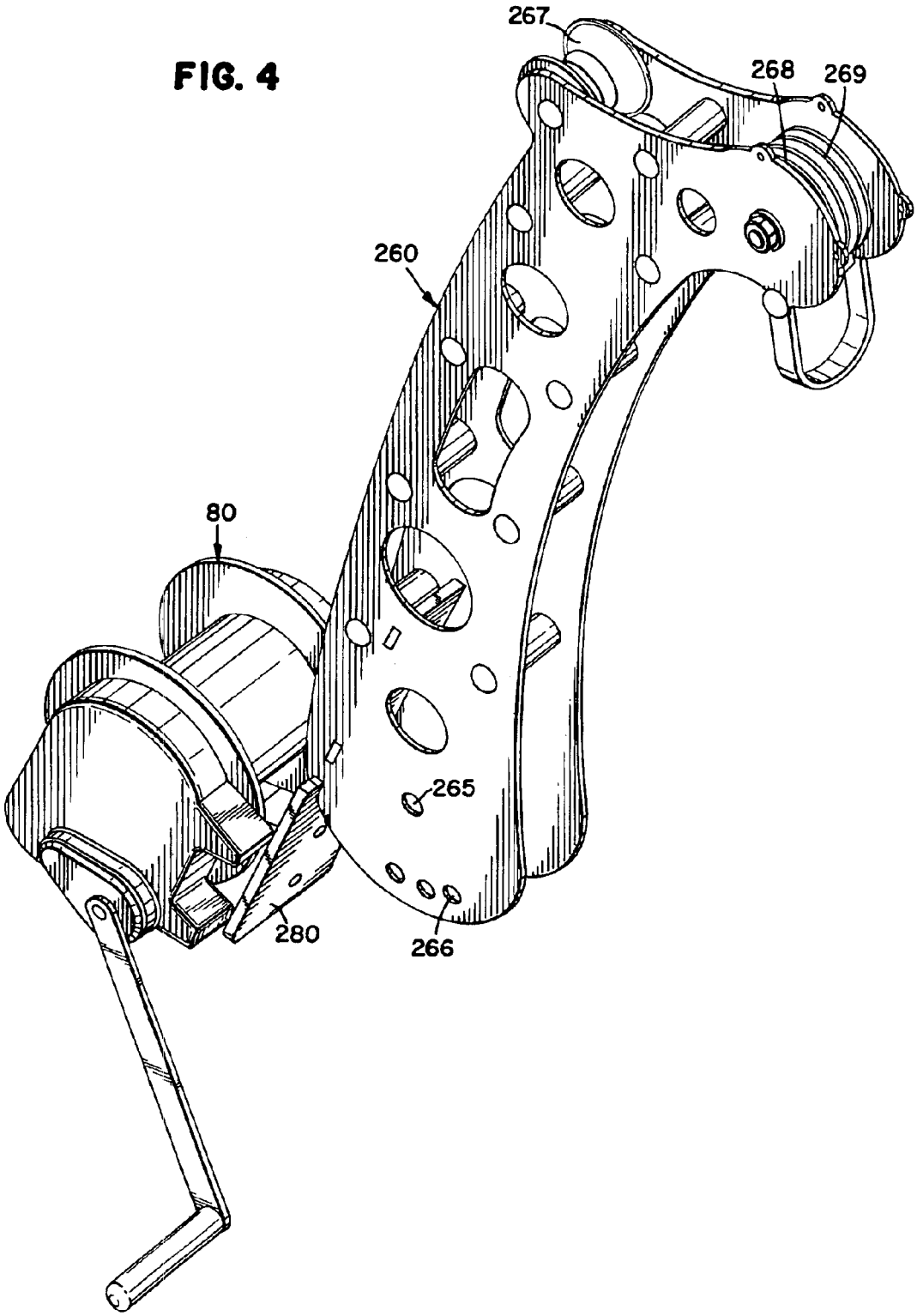
FIG. 4 is a perspective view of a preferred davit arm and winch arrangement constructed according to the principles of the present invention.

On either assembly 101 or 102, the winch and/or the SRL device may be mounted on the davit arm 160 and/or the post 140 in a manner that counterbalances the upper distal end of the davit arm 160 and anything supported thereby. For example, FIG. 4 shows an alternative embodiment davit arm 260 having a mounting bracket 280 that supports a conventional winch 80 in counter-balancing fashion relative to the axis of rotation defined between the davit arm 260 and the associated post (not shown). In addition to the counterbalance effect of the winch 80, another advantage of this arrangement is that the pulleys 267 and 268 remain in alignment with the drum of the winch 80 as the davit arm 260 rotates relative to the post. The lower end of the davit arm 260 is similarly provided with a mounting hole 265 for rotational mounting relative to the rod 150 or another suitable member, and circumferentially spaced holes 266 for locking the davit arm 260 in a desired orientation relative to the rod 150 or other suitable member. On the embodiment shown in FIG. 4, the components are configured and arranged to provide an acceptable fleet angle between the drum on the winch 80 and the associated pulleys 267 and 268 on the davit arm 260.

Figure 5:
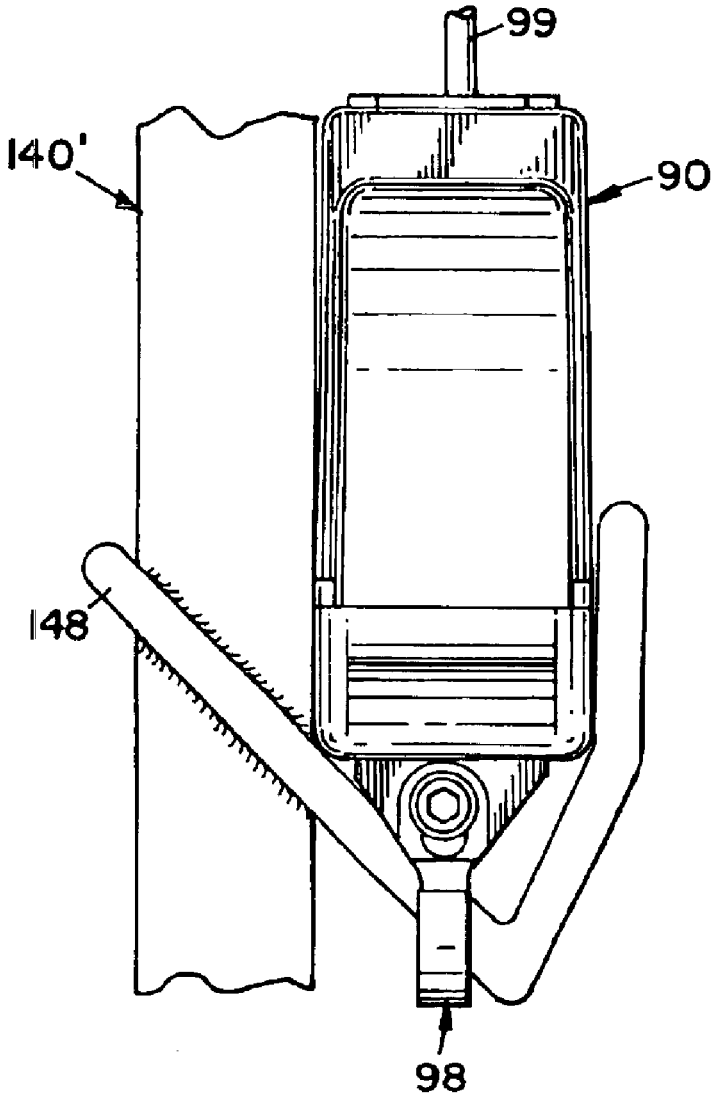
FIG. 5 is a side view of a preferred self-retracting lifeline arrangement constructed according to the principles of the present invention.

FIG. 5 shows a self-retracting lifeline (SRL) device 90 that is disclosed in U.S. Pat. No. 6,206,137 to Wolner et al., which is incorporated herein by reference. Among other things, the SRL device 90 includes a latching mechanism 98 and a safety line 99. FIG. 5 also shows an alternative embodiment post 140' having a bracket 148 secured thereto. The bracket 148 is preferably made by bending a steel rod into a configuration that surrounds three sides of the post 140' and cradles the SRL device 90. The bracket 148 is rigidly secured to the post 140' (by welding, for example). The SRL device 90 slides between the post 140' and the distal ends of the bracket 148, and the latching mechanism 98 locks the SRL device 90 in place. The SRL arrangement shown in FIG. 5 may be implemented alone or in combination with the winch arrangement shown in FIG. 4. An additional pulley 169 or 269 is provided on each of the davit arms 160 and 260, respectively, to accommodate the SRL line 99 apart from the winch line. Depending on the location of the SRL device 90 relative to the post 140', the gap in the upper end of the rod 150 may be used to accommodate passage of the safety line 99 from the SRL device 90 to the pulley 269. Yet another option is to mount a combination winch and self-retracting lifeline assembly on the bracket 280.

Figure 2:
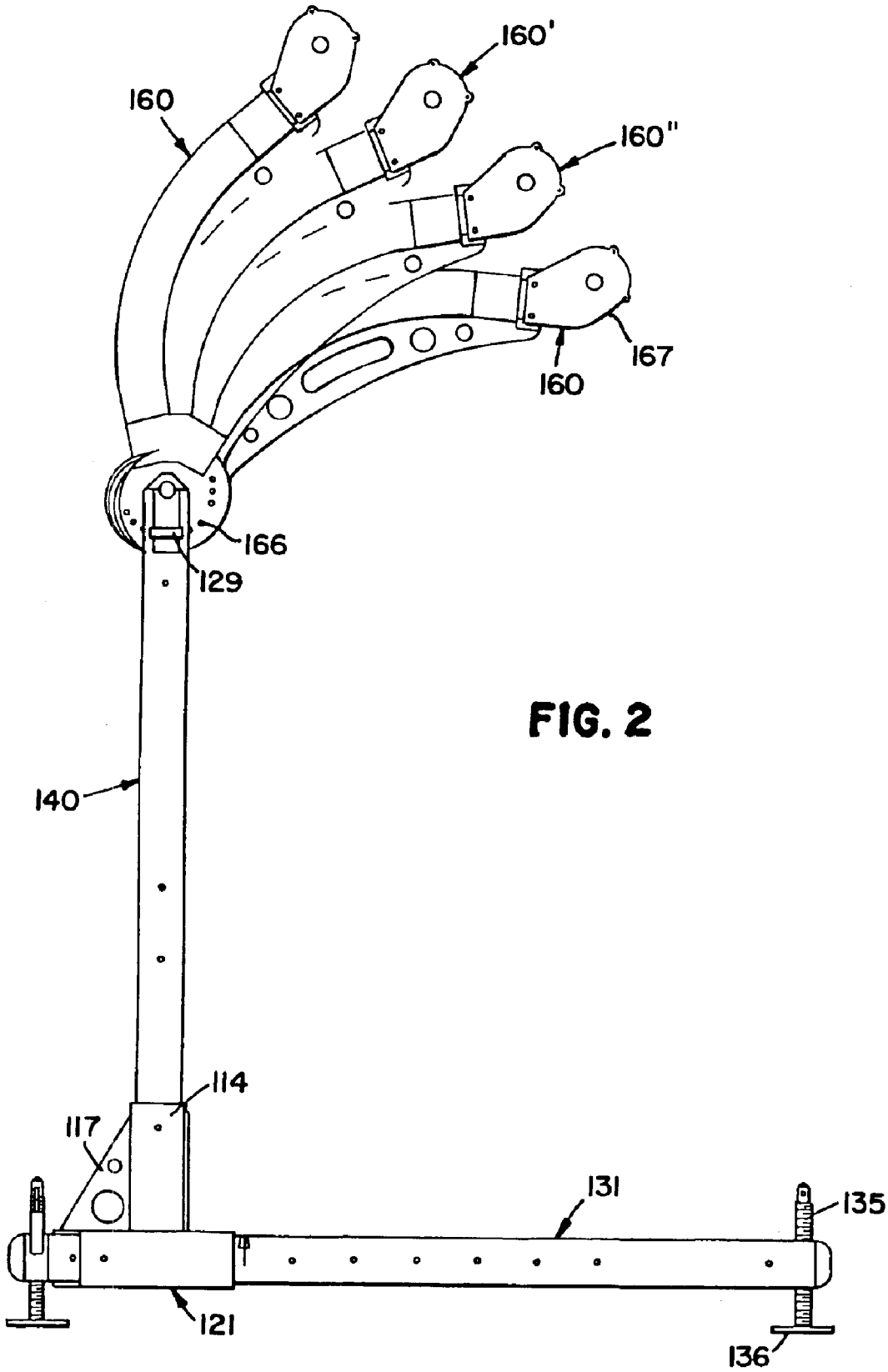
FIG. 2 is a side view of the davit arm and support frame of FIG. 1.
Figure 6A:
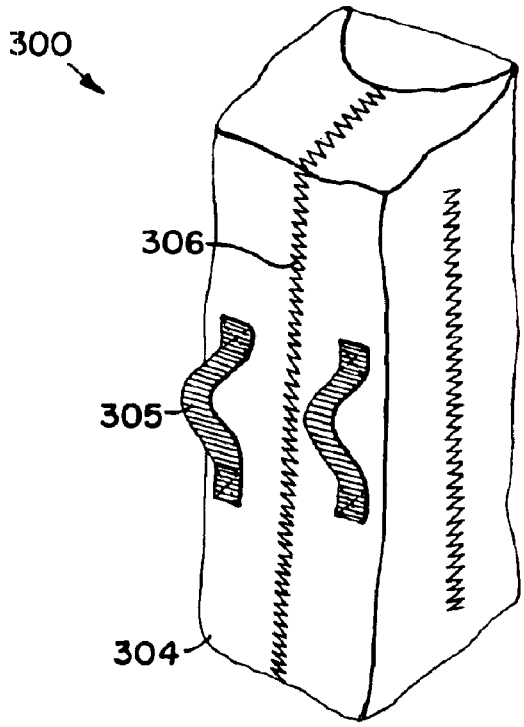
FIG. 6*a* is a perspective view of a portable packaging arrangement for the components of the assembly shown in FIG. 1.
Figure 6B:
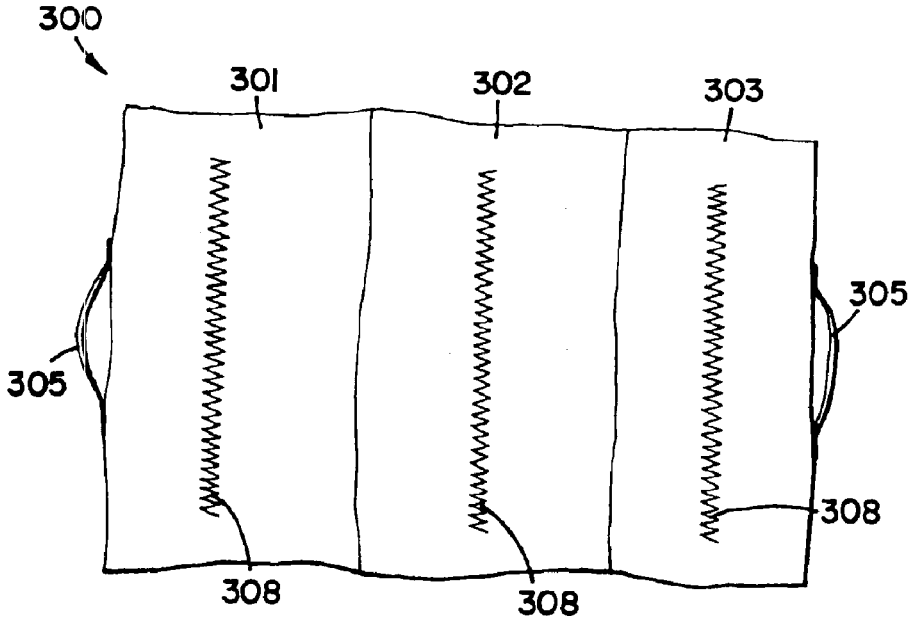
FIG. 6*b* is a plan view of the packaging arrangement of FIG. 6*a* in a second, "unfolded" configuration.

FIGS. 6*a*–6*b* show a packaging arrangement 300 made in accordance with the principles of the present invention. Generally speaking, a bag (made of canvas, for example) includes at least three discrete compartments sized and configured for storing respective components of the assembly 101 shown in FIGS. 1–2. Each compartment is accessible from a respective outer side 301–303 of the bag, via a respective zipper 308, for example. As shown in FIG. 6*a*, a fourth side 304 of the bag is secured together by another zipper 306, which extends across a portion of each end of the bag, as well. Straps 305 are secured to this fourth side 304 of the bag to provide handles and/or shoulder straps (which may be made adjustable in length). When the zipper 306 is open, the bag may be laid flat, in the manner shown in FIG. 6*b*, so that each compartment is accessible via a respective zipper 308. As a result of this packaging arrangement 300, a single person may carry the components of the assembly 101 to a desired location, lay the components out in orderly fashion, and readily construct the assembly 101. Among other things, each compartment may be uniquely marked so that the associated components may be readily identified in accompanying assembly instructions (which may be printed on the bag, for example).

Those skilled in the art will recognize that the present invention may also be described with reference to various methods, including methods of assembling a davit arm assembly (like any of the embodiments disclosed herein), methods of packaging the components of a davit arm assembly for manual transportation by a single person, and/or methods of using a vehicle to anchor and/or position a davit arm assembly.

This disclosure sets forth particular embodiments and specific applications of the present invention, but it will also lead those skilled in the art to derive additional embodiments, improvements, and/or applications. Accordingly, the scope of the present invention should be limited only to the extent of any allowed claims.

What is claimed is:

1. A method of providing a portable davit arm kit sized and configured to be carried by a single person, comprising the steps of:

providing a bag having three discrete compartments;

securing at least one strap to an external portion of the bag in a manner that defines a closed loop;

providing a base member inside a first one of the compartments;

providing first and second leg members inside a second one of the compartments;

providing a first connecting means for connecting the leg members and the base member in a manner that defines a rigid, ground engaging base;

providing a support post and a davit arm inside a third one of the compartments;

providing a second connecting means for connecting the support post and the davit arm to the pound engaging base in such a manner that an upper distal end of the davit arm is disposed above an unoccupied portion of the ground.

2. The method of claim 1, wherein the bag is provided with four external sides, and each of the compartments is accessible from a discrete one of the sides.

3. The method of claim 2, wherein the strap is secured to a discrete one of the sides.

4. The method of claim 2, wherein the bag is provided in a configuration that is capable of lying flat on the ground with each of the three compartments simultaneously accessible from above.

* * * * *

UNITED STATES PATENT AND TRADEMARK OFFICE

CERTIFICATE OF CORRECTION

PATENT NO. : 6,899,238 B2
DATED : May 31, 2005
INVENTOR(S) : Barry J. Austin et al.

It is certified that error appears in the above-identified patent and that said Letters Patent is hereby corrected as shown below:

Column 6,
Line 44, please delete "pound" and insert therefor -- ground --.

Signed and Sealed this

Sixteenth Day of August, 2005

JON W. DUDAS
*Director of the United States Patent and Trademark Office*